US012643579B2

(12) United States Patent
Kagata et al.

(10) Patent No.: US 12,643,579 B2
(45) Date of Patent: Jun. 2, 2026

(54) RAIL VEHICLE

(71) Applicant: Hitachi, Ltd., Tokyo (JP)

(72) Inventors: Satoru Kagata, Tokyo (JP); Kimiyasu Yoshimura, Tokyo (JP); Yosuke Morita, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 476 days.

(21) Appl. No.: 18/547,367

(22) PCT Filed: May 16, 2022

(86) PCT No.: PCT/JP2022/020400
§ 371 (c)(1),
(2) Date: Aug. 22, 2023

(87) PCT Pub. No.: WO2023/223387
PCT Pub. Date: Nov. 23, 2023

(65) Prior Publication Data

US 2025/0010893 A1 Jan. 9, 2025

(51) Int. Cl.
*B61F 5/24* (2006.01)
*B61F 1/14* (2006.01)

(52) U.S. Cl.
CPC . *B61F 5/24* (2013.01); *B61F 1/14* (2013.01)

(58) Field of Classification Search
CPC .... B61F 5/04; B61F 5/22; B61F 5/245; B61F 1/14; B61F 5/24; Y02T 30/00
See application file for complete search history.

(56) References Cited

U.S. PATENT DOCUMENTS 2,782,732 A * 2/1957 Rossell ..... B61F 5/24 105/225
5,107,773 A * 4/1992 Daley ..... B61F 5/14 105/224.1

(Continued)

FOREIGN PATENT DOCUMENTS

CN 108944985 A * 12/2018 ..... B61F 5/24
CN 110667631 A 1/2020

(Continued)

OTHER PUBLICATIONS

International Search Report with English Translation and Written Opinion of International Patent Application No. PCT/JP2022/020400 dated Aug. 2, 2022 (8 pages).

*Primary Examiner* — Paul N Dickson
*Assistant Examiner* — Maxwell L Meshaka
(74) *Attorney, Agent, or Firm* — Foley & Lardner LLP

(57) ABSTRACT

Provided is a rail vehicle that efficiently transmits, to a railway vehicle structure, an oscillating force transmitted from a bogie to an underframe via a yaw damper and a yaw damper support portion, and that has sufficient strength. The underframe includes a floor portion, a side beam, and a bolster beam. A side structure is erected on an end portion in a vehicle width direction of the underframe. The bogie supports the underframe from below the underframe. A yaw damper receiving portion is provided to the end portion in the vehicle width direction of the underframe. The yaw damper support portion is fixed to the yaw damper receiving portion. The yaw damper includes one end portion connected to the bogie and the other end portion connected to the yaw damper support portion. The yaw damper is configured to reduce yawing oscillation of the bogie. The yaw damper receiving portion is provided to extend along the side structure, the side beam, and the bolster beam.

10 Claims, 8 Drawing Sheets

(56) References Cited

U.S. PATENT DOCUMENTS

| | | | | |
|---|---|---|---|---|
| 12,337,880 | B2 * | 6/2025 | Kimura | B61F 1/14 |
| 2022/0281492 | A1 * | 9/2022 | Kimura | B61F 5/04 |
| 2024/0208554 | A1 * | 6/2024 | Miyanaga | B61D 17/10 |
| 2025/0010893 | A1 * | 1/2025 | Kagata | B61F 5/24 |
| 2025/0171058 | A1 * | 5/2025 | Baba | B61F 5/12 |
| 2025/0282397 | A1 * | 9/2025 | Lelouvier | B61F 5/245 |

FOREIGN PATENT DOCUMENTS

| | | | | | |
|---|---|---|---|---|---|
| JP | 2006282059 | A | * | 10/2006 | |
| JP | 2014-125138 | A | | 7/2014 | |
| JP | 2016185791 | A | * | 10/2016 | |
| JP | 6414500 | B2 | * | 10/2018 | |
| KR | 10-2012-0093012 | A | | 8/2012 | |
| WO | WO-2017179480 | A1 | * | 10/2017 | B61F 5/24 |
| WO | WO-2023199369 | A1 | * | 10/2023 | G01M 17/08 |
| WO | WO-2023222823 | A1 | * | 11/2023 | B61F 5/245 |
| WO | WO-2023223387 | A1 | * | 11/2023 | B61F 1/14 |

* cited by examiner

RAIL VEHICLE

TECHNICAL FIELD

The present invention relates to a rail vehicle.

BACKGROUND ART

A railway vehicle structure generally includes an underframe forming a floor, side structures erected on end portions in a width direction of the underframe and forming side faces, end structures erected on end portions in a longitudinal direction of the underframe, and a roof structure provided on upper sides of the side structures and the end structures. Recently, a method of assembling a railway vehicle structure using hollow extruded shape materials of an aluminum alloy has been spreading, for the purpose of weight reduction and improvement of manufacturability. In this method, the hollow extruded shape material of an aluminum alloy includes two facing face plates and a plurality of ribs connecting the face plates, and is used to form each of a roof structure, side structures, an underframe, and the like, thereby assembling these components into the railway vehicle structure.

A bogie, supporting the railway vehicle structure, is provided below the underframe forming the floor. At portions of the underframe supported by the bogie, bolster beams, each of which is a strengthening member, are provided, and via the bolster beams, a tractive force or a braking force, transmitted from the bogie to the vehicle body, is transmitted to the railway vehicle structure.

To each end portion in the width direction of the bolster beam, a yaw damper support portion is provided, and the yaw damper support portion receives connection from a yaw damper that reduces yawing of the bogie causing the bogie to turn on a horizontal plane during high-speed running. One end portion of the yaw damper is connected to the yaw damper support portion included in the underframe (structure), and the other end portion of the yaw damper is connected to a bogie frame forming the bogie, thereby reducing the yawing of the bogie.

PTL 1 discloses an underframe structure of a railway vehicle, capable of reducing out-of-plane bending stress generated in an upper flange and a lower flange, when a couple force acts on the lower flange at a fastening position of a bracket for supporting a bolster anchor or a yaw damper.

CITATION LIST

Patent Literature

PTL 1: JP 2014-125138 A

SUMMARY OF INVENTION

Technical Problem

As a speed of a railway vehicle increases (becomes a high speed), there is a tendency that a load transmitted from a bogie, affected by irregularity of tracks, to an underframe via a yaw damper and a yaw damper support portion increases. For this reason, the irregularity of the tracks may cause an increase in an oscillating force acting, in a rail direction and a vertical direction, on a yaw damper receiving portion, which is a portion via which the yaw damper support portion is fixed to the underframe. Thus, there has been a case of requiring extensive measures for strength of the yaw damper receiving portion.

It is an object of the present invention to provide a rail vehicle that efficiently transmits, to a railway vehicle structure, an oscillating force transmitted from a bogie to an underframe via a yaw damper and a yaw damper support portion, and that has sufficient strength.

Solution to Problem

To achieve the above object, a typical rail vehicle according to the present invention includes:

- an underframe including: a floor portion forming a floor; a side beam provided in a vehicle longitudinal direction along an end portion in a vehicle width direction of the floor portion; and a bolster beam provided on a lower face of the side beam and a lower face of the floor portion, the bolster beam extending in the vehicle width direction across the side beam and the floor portion;
- a side structure erected on an end portion in the vehicle width direction of the underframe;
- a bogie supporting the underframe from below the underframe;
- a yaw damper receiving portion provided to the end portion in the vehicle width direction of the underframe;
- a yaw damper support portion fixed to the yaw damper receiving portion; and
- a yaw damper including one end portion connected to the bogie and another end portion connected to the yaw damper support portion, the yaw damper being configured to reduce yawing oscillation of the bogie,
- where the yaw damper receiving portion is provided to extend along the side structure, the side beam, and the bolster beam.

Advantageous Effects of Invention

According to the present invention, it is possible to provide a rail vehicle that efficiently transmits, to a railway vehicle structure, an oscillating force transmitted from a bogie to an underframe via a yaw damper and a yaw damper support portion, and that has sufficient strength.

Problems, configurations, and effects other than those described above will be made apparent by the following description of embodiments.

DESCRIPTION OF EMBODIMENTS

Hereinafter, embodiments for implementing the invention will be described with reference to the drawings.

A rail vehicle is a generic term for vehicles operated along a laid track 5 or laid tracks 5, and means a railway vehicle, a streetcar, a new transportation system vehicle, a monorail vehicle, or the like. By exemplifying a railway vehicle as a typical rail vehicle, the embodiments of the present invention will be described.

First, each direction is defined. A longitudinal (rail) direction of the railway vehicle is defined as an x-direction (vehicle longitudinal direction). A width (sleeper) direction of the railway vehicle is defined as a y-direction (vehicle width direction). A height direction of the railway vehicle is defined as a z-direction. Hereinafter, these directions may be simply referred to as the x-direction, the y-direction, and the z-direction.

Figure 1:
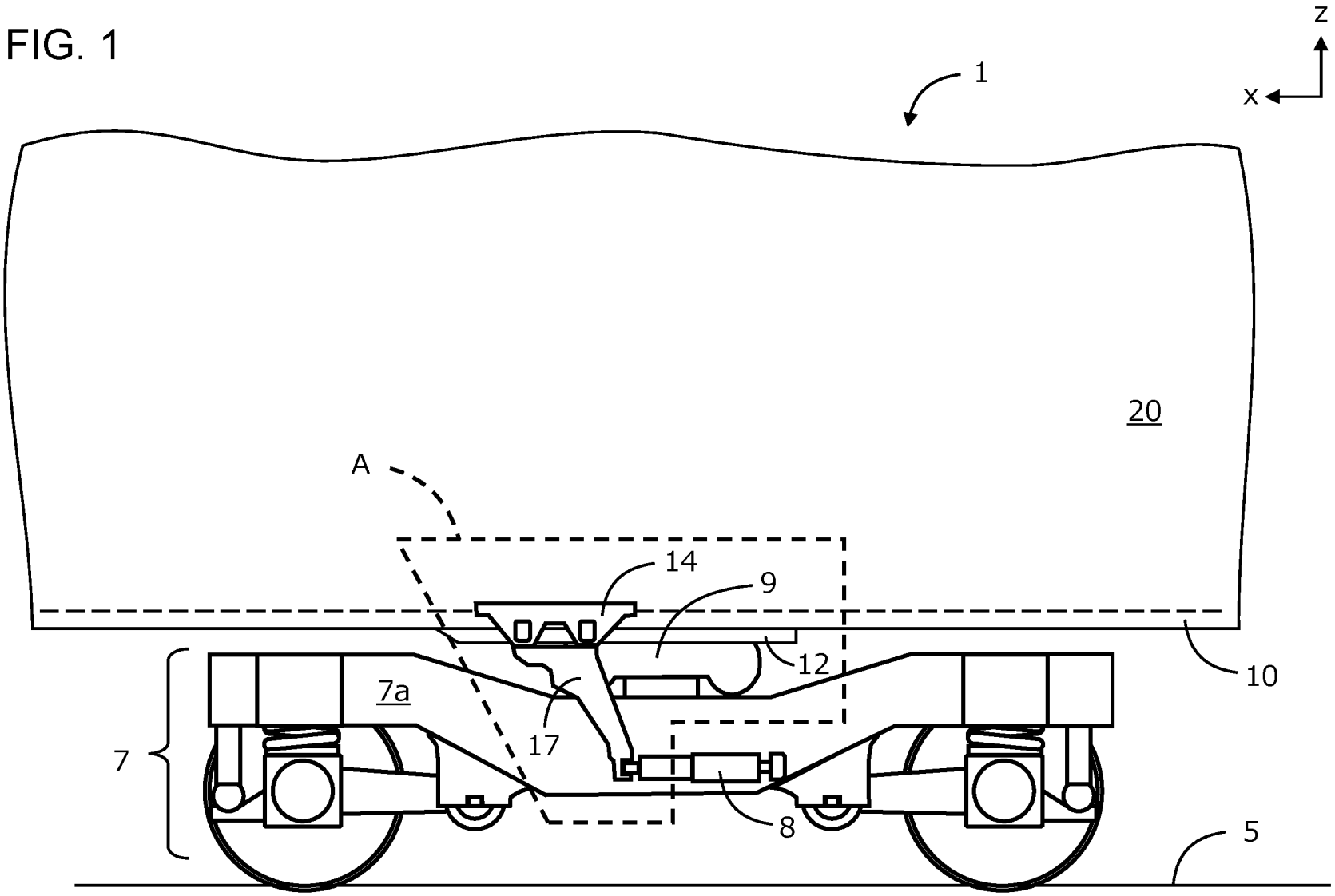
FIG. 1 is a side view illustrating a railway vehicle.
Figure 2:
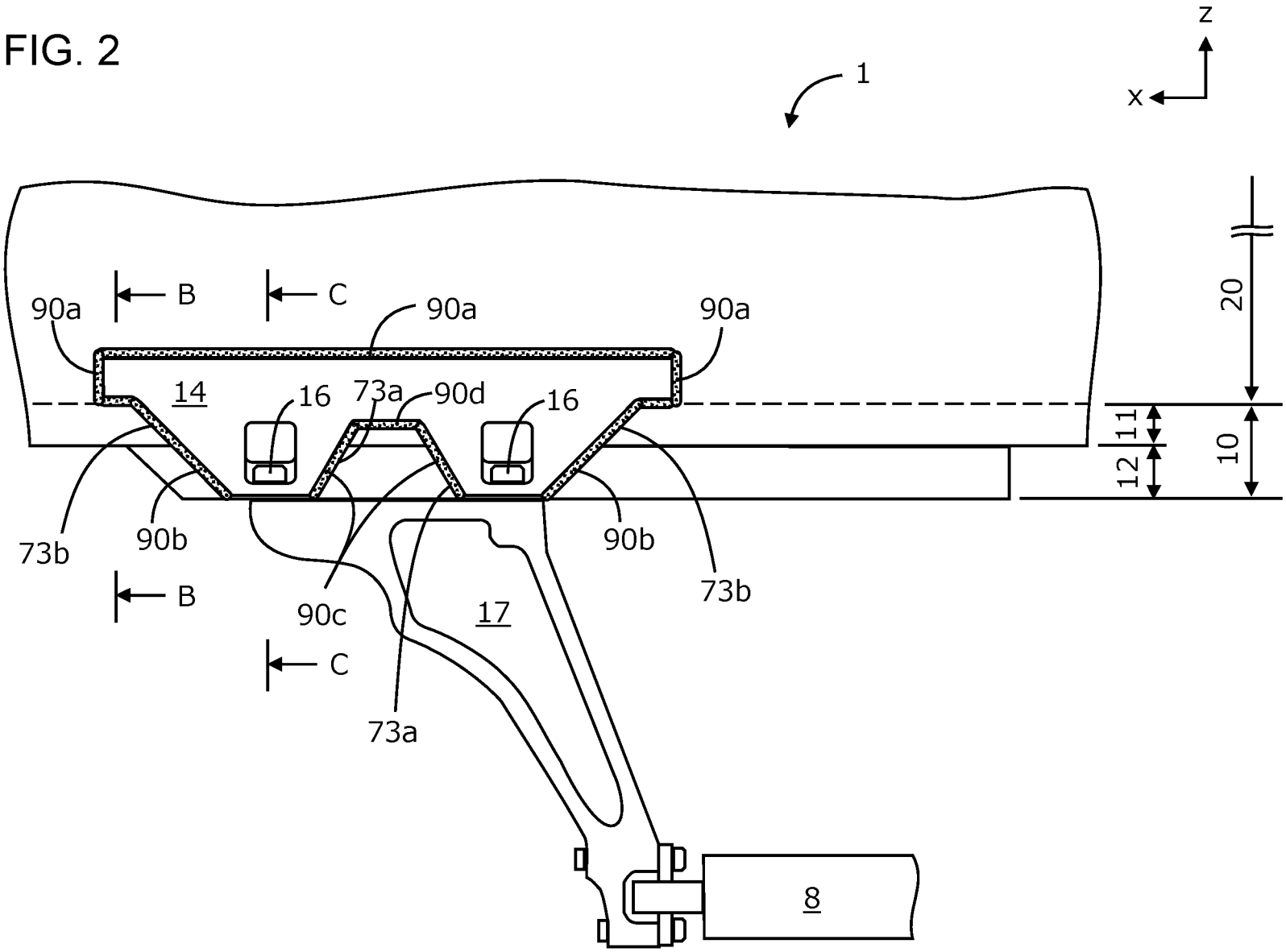
FIG. 2 is an enlarged view illustrating part A of the railway vehicle illustrated in FIG. 1.

FIG. 1 is a side view illustrating a railway vehicle, and FIG. 2 is an enlarged view illustrating part A of the railway vehicle illustrated in FIG. 1. A structure of a railway vehicle 1 includes an underframe 10 forming a floor, a pair of side structures 20 erected on both end portions in the y-direction of the underframe 10, a pair of end structures (not illustrated) erected on both end portions in the x-direction of the underframe 10, and a roof structure (not illustrated) placed on upper end portions of the side structures 20 and the end structures. Each side structure 20 is erected while extending in the x-direction, and each end structure is erected while extending in the y-direction. The underframe 10 is supported by a bogie 7 from below.

The underframe 10 includes a pair of side beams 11 spaced apart at both end portions in the y-direction, a pair of end beams (not illustrated) spaced apart at both end portions in the x-direction, a bolster beam 12 disposed near a central portion in the x-direction of the underframe 10 and connecting the pair of side beams 11, and a pair of intermediate beams (not illustrated) connecting the bolster beam 12 and the end beams (not illustrated) and including a coupler support. Each side beam 11 is a strengthening member provided in a manner to extend in the x-direction, and the bolster beam 12 is a strengthening member provided in a manner to extend in the y-direction from each side beam 11.

The bolster beam 12 is a strengthening member placed on upper faces of primary springs 9 (for example, air springs 9 or the like) included in the bogie 7. The bogie 7 supports the load of the railway vehicle 1 via the primary springs 9 and the bolster beam 12. A yaw damper receiving portion 14 is provided to an end portion in the y-direction of the bolster beam 12 (an end portion in the y-direction of the underframe 10). On a lower end portion of the yaw damper receiving portion 14, a yaw damper support portion 17 is provided in a manner to extend downward.

The bogie 7 including wheelsets rolling along the tracks 5 is provided below the bolster beam 12 included in the underframe 10. The bogie 7 is provided with a yaw damper 8, which is provided along a side face of a bogie frame 7*a* in a manner to extend in the x-direction. The yaw damper 8 includes one end portion connected to the bogie frame 7*a*, and the other end portion connected to a lower end portion of the yaw damper support portion 17. The yaw damper support portion 17 includes an upper end portion fastened to the lower end portion of the yaw damper receiving portion 14 by a pair of bolts 16 spaced apart in the x-direction.

Figure 3:
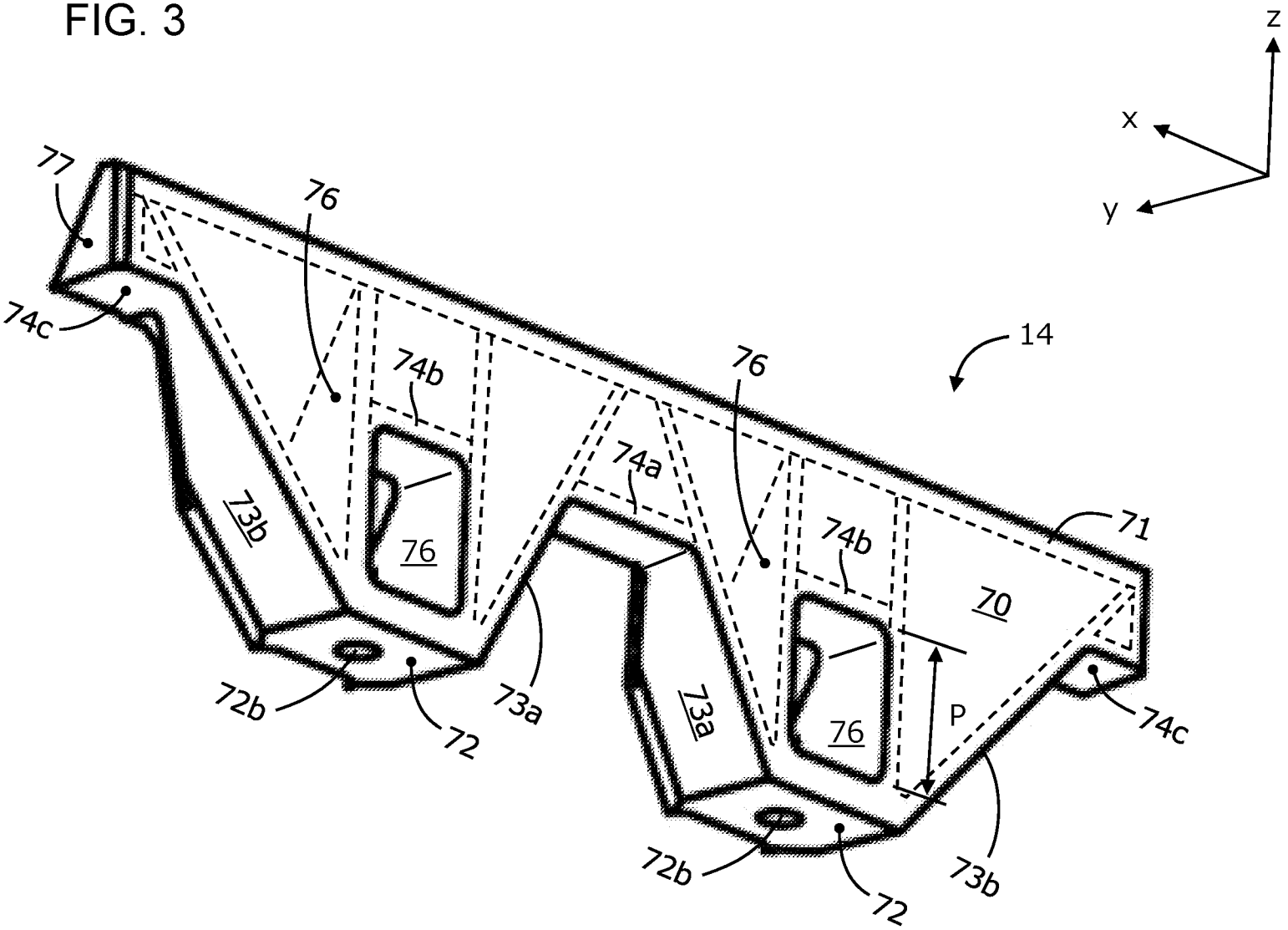
FIG. 3 is a perspective view illustrating a yaw damper receiving portion as viewed from the outside of the vehicle.
Figure 4:
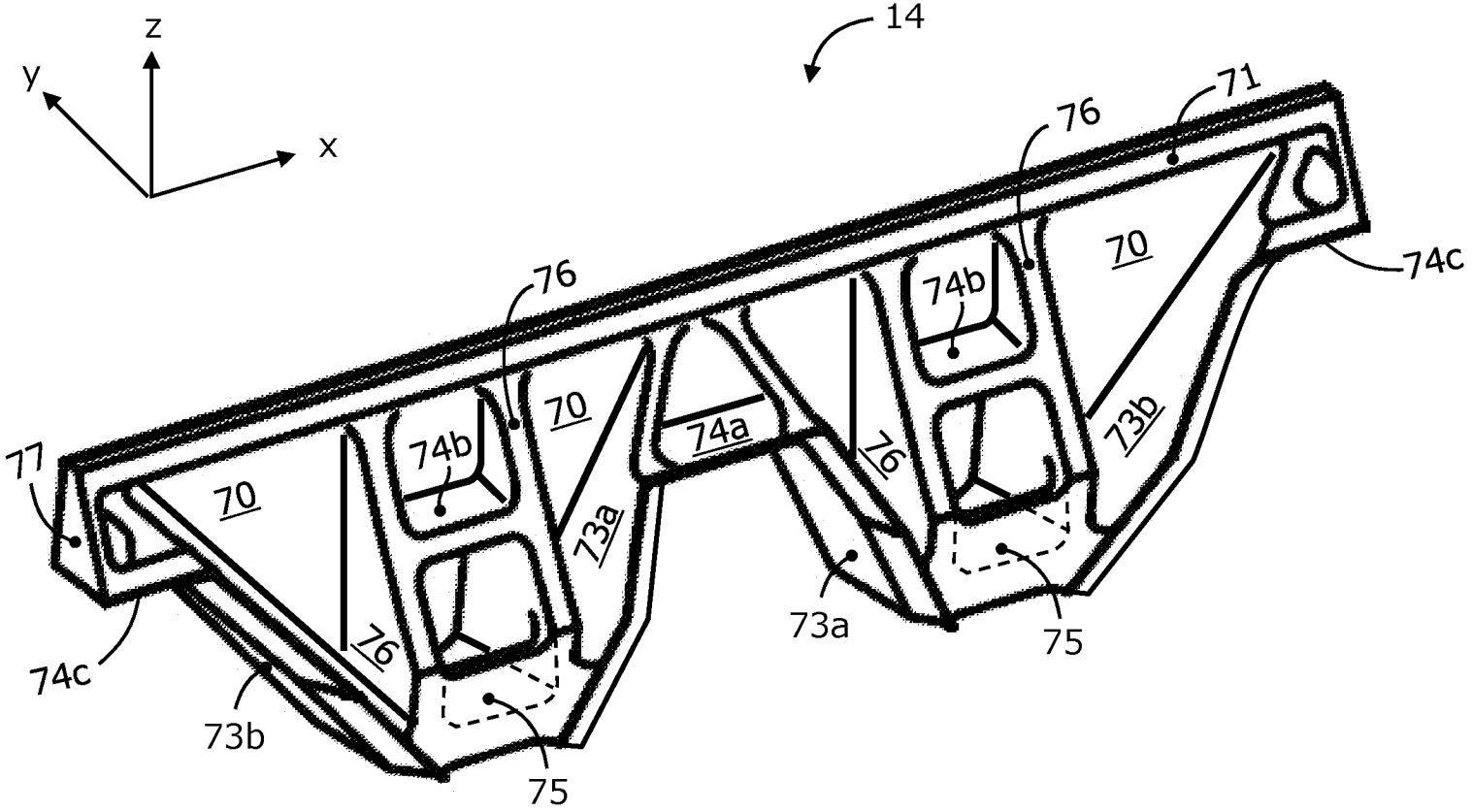
FIG. 4 is a perspective view illustrating the yaw damper receiving portion as viewed from a center side in a width direction of a vehicle body.

FIG. 3 is a perspective view illustrating the yaw damper receiving portion as viewed from the outside of the vehicle, and FIG. 4 is a perspective view illustrating the yaw damper receiving portion as viewed from a center side in the width direction of the vehicle body.

The yaw damper receiving portion 14 includes a first face plate 70 and an upper end edge portion 71. The first face plate 70 is a flat plate-shaped member including two trapezoidal portions (trapezoidal regions) having respective upper long sides and respective lower short sides. The two trapezoidal portions are arranged such that the long sides of the trapezoidal portions are adjacent to each other in a manner to be substantially the same straight line in the x-direction. The two trapezoidal portions are also arranged in a manner to belong to substantially the same plane. The upper end edge portion 71 is a plate-shaped portion that protrudes from a portion corresponding to the long sides of the continuous two trapezoidal portions, and that is provided across substantially the entire length of an upper end edge of the first face plate 70.

The yaw damper receiving portion 14 further includes bottom plates 72, first inclined portions 73*a*, and second inclined portions 73*b*. Each of the bottom plates 72, each of the first inclined portions 73*a*, and each of the second inclined portions 73*b* are connected to a corresponding one of the two trapezoidal portions of the first face plate 70. Each of the bottom plates 72 is a flat plate-shaped portion extending in the y-direction (horizontal direction) from a portion corresponding to the short side of the corresponding one of the trapezoidal portions (a lower end edge portion of the trapezoidal portion) of the first face plate 70. Each of the bottom plates 72 is provided across substantially the entire length of the lower end edge portion of the corresponding trapezoidal portion.

Each of the first inclined portions 73*a* is a flat plate-shaped portion extending in the y-direction from a portion corresponding to one inclined side of the corresponding one of the trapezoidal portions of the first face plate 70. Each of the first inclined portions 73*a* connects one end edge portion in the x-direction of a corresponding one of the bottom plates 72 (an end edge portion of the bottom plate 72 on a central portion side in the x-direction of the yaw damper receiving portion 14, out of both end edge portions in the x-direction of the bottom plate 72) and a central portion in the y-direction of the upper end edge portion 71. Each of the first inclined portions 73*a* is provided across substantially the entire length of the one inclined side of the corresponding trapezoidal portion.

Each of the second inclined portions 73*b* is a flat plate-shaped portion extending in the y-direction from a portion corresponding to another inclined side of the corresponding one of the trapezoidal portions of the first face plate 70. Each of the second inclined portions 73*b* connects the other end edge portion in the x-direction of a corresponding one of the bottom plates 72 and the vicinity of a corresponding one of end portions in the y-direction of the upper end edge portion 71. Each of the second inclined portions 73*b* is provided across substantially the entire length of the other inclined side of the corresponding trapezoidal portion.

The first inclined portion 73*a* and the second inclined portion 73*b* provided on the same trapezoidal portion are inclined such that a distance between the first inclined portion 73*a* and the second inclined portion 73*b* increases (the first inclined portion 73*a* and the second inclined portion 73*b* are separated from each other) as the first inclined portion 73*a* and the second inclined portion 73*b* extend upward. One of the first inclined portions 73*a* provided on one of the trapezoidal portions and the other first inclined portion 73*a* provided on the other trapezoidal portion are arranged side by side in the x-direction in the central portion in the x-direction of the yaw damper receiving portion 14. These two first inclined portions 73*a* are inclined such that a distance between the first inclined portions 73*a* decreases (the first inclined portions 73*a* approach each other) as the first inclined portions 73*a* extend upward. The bottom plates 72, the first inclined portions 73*a*, and the second inclined portions 73*b* protrude inward in the vehicle width direction from the first face plate 70.

The yaw damper receiving portion 14 further includes end face portions 77 and third horizontal portions 74*c*. Each of the end face portions 77 is a substantially triangular plate-shaped portion that is provided on a corresponding one of both end portions in the x-direction of the upper end edge portion 71, that intersects with the x-direction, and that extends in the y-direction from the corresponding one of both end portions in the x-direction of the upper end edge portion 71. Each of the third horizontal portions 74*c* is a flat plate-shaped portion that extends in the x-direction and the y-direction (horizontal direction) from a lower end edge of a corresponding one of the end face portions 77 and a lower end edge of the upper end edge portion 71, and that is connected to an upper end portion of a corresponding one of the second inclined portions 73*b*.

In FIG. 3, the yaw damper receiving portion 14 includes pairs of vertical portions 76 and second horizontal portions (horizontal portions above the bottom plates) 74*b*. Each pair of vertical portions 76 and each of the second horizontal portions 74*b* are provided for a corresponding one of the two trapezoidal portions of the first face plate 70. Each pair of vertical portions 76 are substantially triangular plate-shaped portions extending upward in a vertical direction (+z-direction) from both end edge portions in the x-direction of a corresponding one of the bottom plates 72 (FIG. 3) toward an upper end of the upper end edge portion 71. Each of the second horizontal portions 74*b* is a flat plate-shaped portion that connects substantially central portions in the z-direction of the pair of vertical portions 76, and that is provided above and substantially parallel to a corresponding one of the bottom plates 72. Each pair of vertical portions 76 and each of the second horizontal portions 74*b* protrude inward in the vehicle width direction from the first face plate 70.

The yaw damper receiving portion 14 further includes second face plates 75. Each of the second face plates 75, provided for a corresponding one of the two trapezoidal portions of the first face plate 70, is erected in the z-direction from an edge portion of an end portion in the y-direction of a corresponding one of the bottom plates 72. The second face plate 75 includes a lower end portion in the z-direction connected to the bottom plate 72, and both end portion edges in the x-direction connected to the pair of vertical portions 76, while the second face plate 75 also includes an upper end edge in the z-direction forming an open end edge that is not connected to any portion.

The yaw damper receiving portion 14 includes a first horizontal portion 74*a*. The first horizontal portion 74*a* is a flat plate-shaped portion extending along the upper end edge portion 71 and connecting central portions in the z-direction of the two first inclined portions 73*a* adjacent in the x-direction. The first horizontal portion 74*a* protrudes inward in the vehicle width direction from the first face plate 70.

In FIG. 3, the bottom plates 72 include respective bolt holes 72*b* through which the bolts 16 for fastening the yaw damper support portion 17 provided under the bottom plates 72 pass. The upper end portion of the yaw damper support portion 17 overlaps from below with the two bottom plates 72 arranged in the x-direction, and is fastened and fixed to the bottom plates 72 by the bolts 16.

The yaw damper receiving portion 14 includes two openings P. The two openings P are provided at respective centers of the two trapezoidal portions of the first face plate 70. Each of the openings P is a space formed by the bottom plate 72, the pair of vertical portions 76, the second horizontal portion 74*b*, and the second face plate 75, and passes through the first face plate 70 to open in the vehicle width direction (y-direction). Each of the openings P can receive insertion of a tool for loosening the bolt 16 for fastening the yaw damper support portion 17 to the yaw damper receiving portion 14 welded to the railway vehicle 1.

The yaw damper receiving portion 14 may be manufactured from an aluminum alloy by a cutting process, or may be manufactured by assembling, through welding, each face plate, each inclined portion, and each horizontal portion, prepared as discrete components. The shape of the yaw damper receiving portion 14 is not limited to the one described above.

Figure 5:
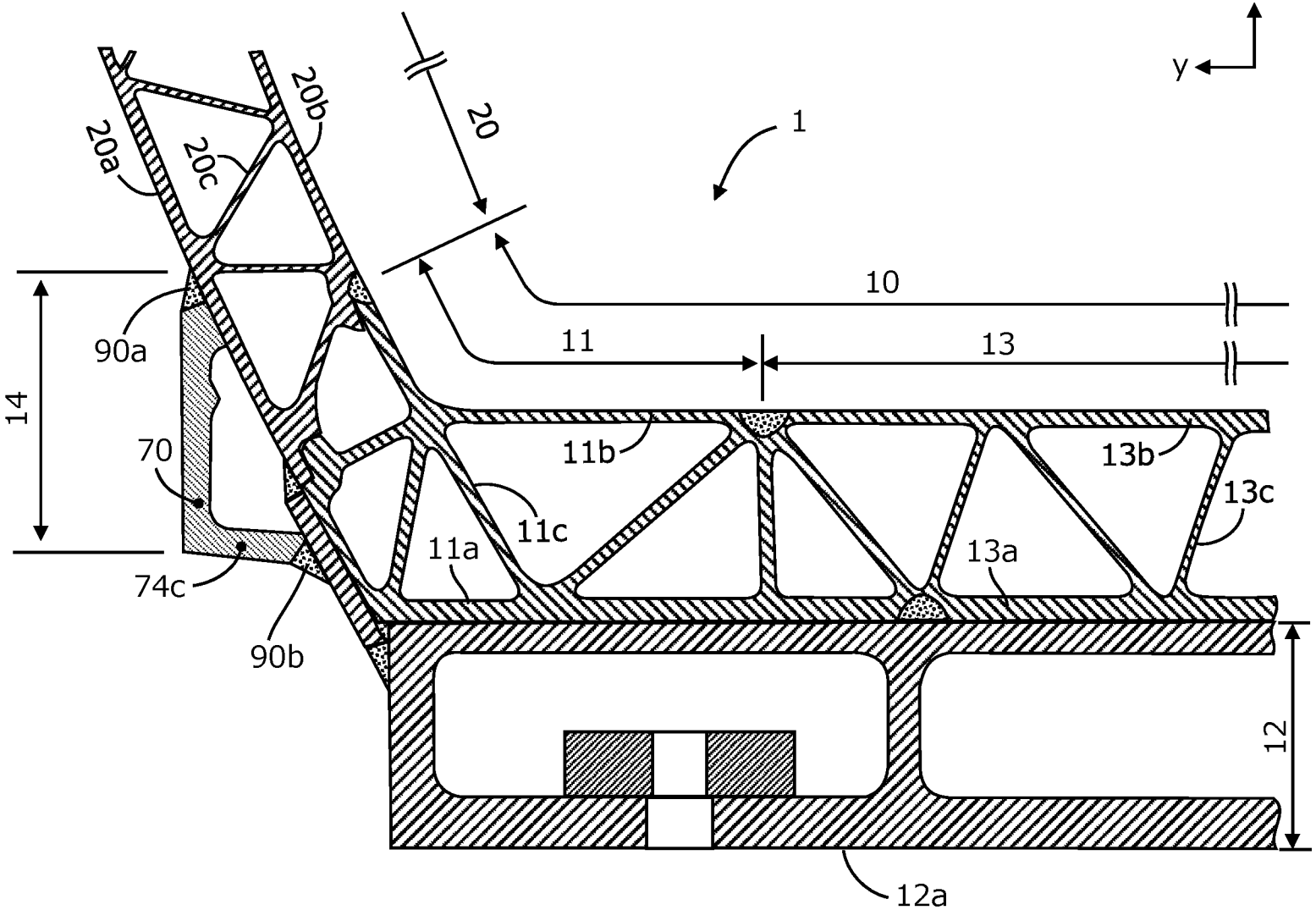
FIG. 5 is a cross-sectional view illustrating the yaw damper receiving portion and a periphery thereof, the view being taken along line B-B in FIG. 2.
Figure 6:
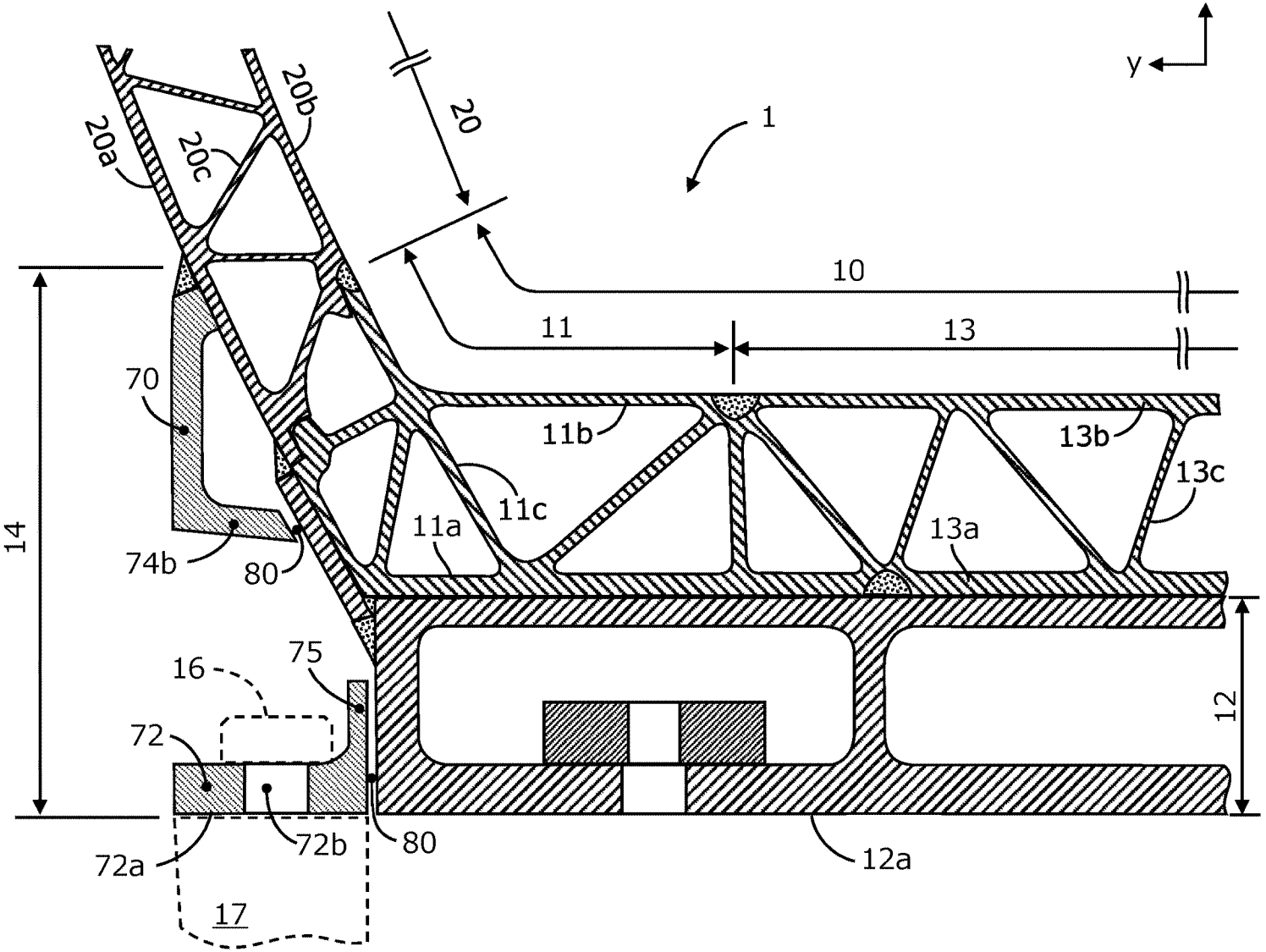
FIG. 6 is a cross-sectional view illustrating the yaw damper receiving portion and a periphery thereof, the view being taken along line C-C in FIG. 2.

FIG. 5 is a cross-sectional view illustrating the yaw damper receiving portion and a periphery thereof, the view being taken along line B-B in FIG. 2. FIG. 6 is a cross-sectional view illustrating the yaw damper receiving portion and a periphery thereof, the view being taken along line C-C in FIG. 2.

The structure of the railway vehicle 1 includes a floor portion 13 forming a floor, the side beams 11 provided in the x-direction along both end portions in the y-direction of the floor portion 13, and the side structures 20 extending upward (+z-direction) from the side beams 11. Under the side beams 11 and the floor portion 13, the bolster beam 12, extending from one of the side beams 11 to the other one of the side beams 11 via the floor portion 13, is provided to support the side beams 11 and the floor portion 13. The side beams 11 and the floor portion 13 forming the floor of the structure, and the bolster beam 12 arranged on lower faces thereof are included in the underframe 10.

The side structure 20 is formed of a hollow extruded shape material obtained by integrally extruding a vehicle outer face plate 20*a*, a vehicle inner face plate 20*b*, and ribs 20*c* connecting these face plates, in the x-direction. The side beam 11 is formed of a hollow extruded shape material including a vehicle outer face plate 11*a*, a vehicle inner face plate 11*b*, and ribs 11*c* connecting these face plates. The floor portion 13 is formed of a hollow extruded shape material including a vehicle outer face plate 13*a*, a vehicle inner face plate 13*b*, and ribs 13*c* connecting these face plates. The structure of the railway vehicle 1 is formed by joining, through welding or the like, a butted portion between a lower end portion of the side structure 20 and an upper end portion of the side beam 11, and by joining, through welding or the like, a butted portion between the side beam 11 and the floor portion 13.

The yaw damper receiving portion 14 is welded to the lower end portion of the side structure 20, the side beam 11, and the bolster beam 12, in a manner to extend thereacross. With reference to FIGS. 2 and 5, the upper end of the upper end edge portion 71 of the yaw damper receiving portion 14 and sides of the pair of end face portions 77 thereof are welded to the vehicle outer face plate 20*a* of the side structure 20 through a weld portion 90*a*. Sides of the first inclined portions 73*a* of the yaw damper receiving portion 14 are welded to the vehicle outer face plate 11*a* of the side beam 11 and the bolster beam 12 through weld portions 90*c*. Sides of the second inclined portions 73*b* of the yaw damper receiving portion 14 are welded to the vehicle outer face plate 11*a* of the side beam 11 and the bolster beam 12 through weld portions 90*b*. A side of the first horizontal portion 74*a* is welded to the vehicle outer face plate 11*a* of the side beam 11 through a weld portion 90*d*.

When the yaw damper receiving portion 14 is welded to the structure of the railway vehicle 1, a lower face 72*a* of each bottom plate 72 of the yaw damper receiving portion 14 is positioned at a position substantially flush with a lower face 12*a* of the bolster beam 12, the yaw damper receiving portion 14 is temporarily welded to the side structure 20, the side beam 11, and the bolster beam 12, and then the weld portions 90*a*, 90*b*, 90*c*, 90*d* are welded. The lower face 72*a* of the bottom plate 72 of the yaw damper receiving portion 14 is arranged to be substantially flush with the lower face 12*a* of the bolster beam 12, and thus the yaw damper receiving portion 14 does not protrude downward from the lower face 12*a* of the bolster beam 12.

At this time, a stiffening plate or the like may be provided for reinforcement on each vehicle outer face plate as necessary in order to form sound weld portions, in a weld portion between the yaw damper receiving portion 14 and the vehicle outer face plate 20*a* of the side structure 20 and/or a weld portion between the yaw damper receiving portion 14 and the vehicle outer face plate 11*a* of the side beam 11.

A water drainage flow passage 80 is provided to form a gap between each of the second face plate 75 and the second horizontal portion 74*b* forming the opening P, and an end face in the y-direction of the underframe 10 (an end face in the y-direction of the bolster beam 12 and an end face in the y-direction of the side beam 11). This allows rainwater or the like, having entered the inside of the yaw damper receiving portion 14 (a space between the first face plate 70 and each of the underframe 10 and the side structure 20) to be discharged through the water drainage flow passage 80 to the outside of the yaw damper receiving portion 14. Note that the water drainage flow passage 80 may be omitted, when, even though there is a risk of rainwater or the like entering, treatment is made such as sealing a gap portion of the yaw damper receiving portion 14 with a waterproof seal.

Figure 7:
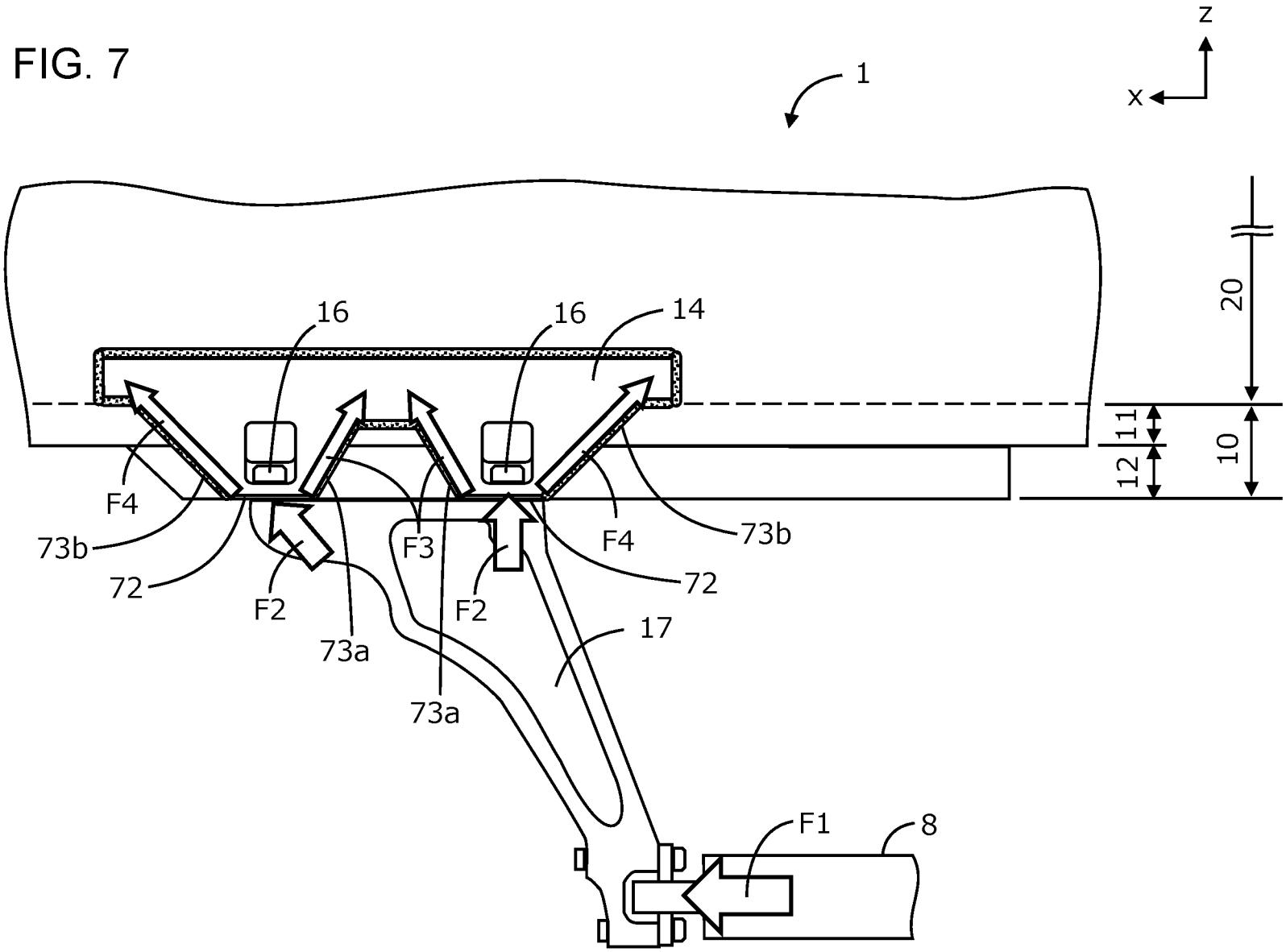
FIG. 7 is a schematic view illustrating a state in which force from a yaw damper acting on the yaw damper receiving portion via a yaw damper support portion is transmitted to a structure of the railway vehicle.

FIG. 7 is a schematic view illustrating a state in which force from the yaw damper acting on the yaw damper receiving portion via the yaw damper support portion is transmitted to the structure of the railway vehicle.

When the railway vehicle 1 runs, irregularity of the tracks 5 or the like causes the bogie 7 to be subjected to pitching oscillation (oscillation about the y-axis centered on the center of gravity of the bogie 7), rolling oscillation (oscillation about the x-axis centered on the center of gravity of the bogie 7), and yawing oscillation (oscillation about the z-axis centered on the center of gravity of the bogie 7), with respect to the vehicle body. In particular, the yawing oscillation likely to be remarkable at the time of high-speed running tends to cause an increase in lateral force with which wheels push the tracks in a left-right direction. Thus, the yawing oscillation of the bogie 7 is reduced by providing the yaw dampers 8 between the bogie 7 and the structure of the railway vehicle 1.

In the course of reducing the yawing oscillation of the bogie 7, the yaw damper 8 oscillates the lower end portion of the yaw damper support portion 17 with an oscillating force F1. As the oscillating force F1, a force acting in the +x-direction and a force acting in the −x-direction are alternately observed. Here, the force acting in the +x-direction will be representatively described.

The oscillating force F1 acting on the lower end portion of the yaw damper support portion 17 is divided into oscillating forces F2 and transmitted via the bolts 16 to the bottom plates 72 of the yaw damper receiving portion 14 to which the upper end portion of the yaw damper support portion 17 is connected. Further, each of the oscillating forces F2 acting on the bottom plates 72 of the yaw damper receiving portion 14 is divided into an oscillating force F3 along the first inclined portion 73*a* connected to the bottom plate 72 and an oscillating force F4 along the second inclined portion 73*b* connected to the bottom plate 72, and these oscillating forces are transmitted to the structure of the railway vehicle 1.

The first inclined portion 73*a* is welded through the weld portion 90*c* across the bolster beam 12 and the side beam 11 (see FIG. 2). Thus, the oscillating force F3 along the first inclined portion 73*a* is transmitted to the bolster beam 12 and the side beam 11. Similarly, the second inclined portion 73*b* is welded through the weld portion 90*b* (a part thereof is welded through the weld portion 90*a*) along the bolster beam 12, the side beam 11, and the side structure 20 (see FIG. 2). Thus, the oscillating force F4 along the second inclined portion 73*b* is transmitted to the bolster beam 12, the side beam 11, and the side structure 20.

An oscillating force F2 includes an oscillating force as an x-direction component and an oscillating force as a z-direction component. Thus, when the yaw damper receiving portion 14 is welded to the structure of the railway vehicle 1 only through a weld portion in the x-direction or a weld portion in the z-direction, a one-directional oscillating force included in the oscillating force F2 acts in a direction intersecting a weld line of the weld portion. Therefore, high stress is likely to be generated in the weld portion, and the strength is likely to decrease. Further, allowable stress for a joint on which a repetitive load acts in the direction intersecting the weld line of the weld portion is low, and thus the structure may be complex in order to ensure sufficient strength.

In contrast, the first inclined portion 73*a* and the second inclined portion 73*b* are welded to the structure of the railway vehicle 1 in a manner to be inclined with respect to the x-direction and the z-direction (the weld portion 90*b* and the weld portion 90*c*). Thus, the x-direction component and the z-direction component of the oscillating force F2 are oriented in a direction along the weld line of the weld portion 90*b* (90*c*), and high stress is less likely to be generated in the weld portions 90*b*, 90*c*. In addition, allowable stress for a joint on which a repetitive load acts in a direction parallel to the weld line of the weld portion is higher than the allowable stress for the joint in the case where the repetitive load acts in the direction intersecting the weld line. Thus, endurance strength of the weld portion can be increased.

The opening P of the yaw damper receiving portion 14 is configured as a box-shaped inner space formed by a total of five faces including the bottom plate 72, the pair of vertical portions 76 connected to the bottom plate 72, the second horizontal portion 74*b* horizontally connecting the pair of vertical portions 76, and the second face plate 75 connected to the bottom plate 72 and lower portions of the pair of vertical portions 76 (see FIGS. 3 and 4). Thus, when the oscillating force as the x-direction component and the oscillating force as the z-direction component act on the bottom plate 72, the second face plate 75 particularly has a bracing function of being connected to both the vertical portions 76 forming a pair of facing faces and the bottom plate 72 connecting lower end portions of the vertical portions 76, and thus it is possible to appropriately guide the oscillating force F2 acting on the bottom plate 72 to the first inclined portion 73*a* and the second inclined portion 73*b*, without causing a significant decrease in strength.

Further, the yaw damper receiving portion 14 is fixed to the side structure 20, the side beam 11, and the bolster beam 12. Thus, the number of manufacturing steps can be reduced as compared with, for example, that in a case where a yaw damper receiving portion is fixed only to the bolster beam 12 and a reinforcing member is additionally attached for transmitting an oscillating force input from the yaw damper receiving portion to the side beam 11 and the side structure 20.

Figure 8:
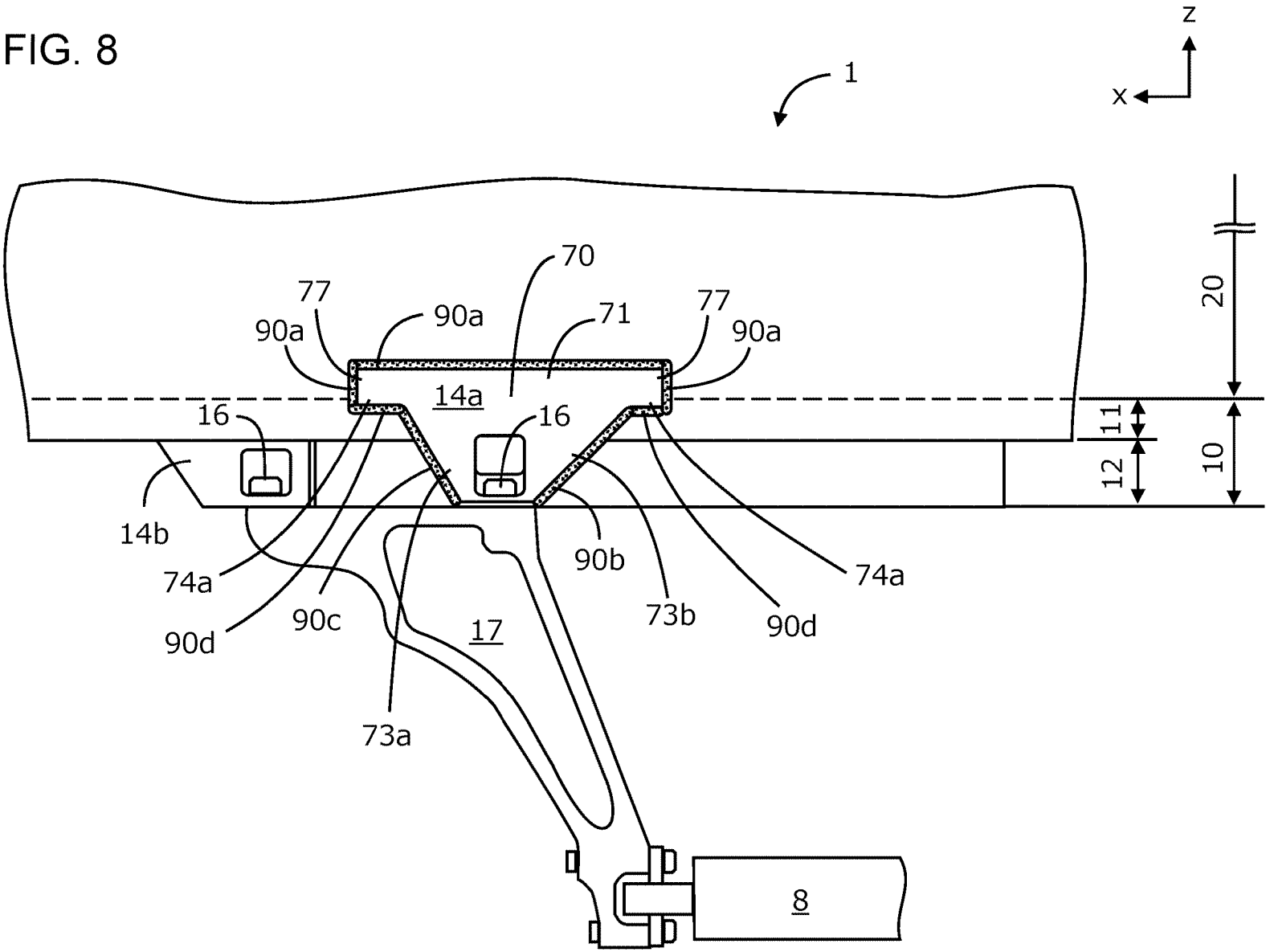
FIG. 8 is a side view illustrating a railway vehicle including a yaw damper receiving portion according to another embodiment.

FIG. 8 is a side view illustrating a railway vehicle including a yaw damper receiving portion according to another embodiment. The railway vehicle 1 may be subjected to rolling oscillation because the railway vehicle 1 is supported by the bogie 7 via the air springs 9 provided at both end portions in the y-direction of the bolster beam 12 included in the underframe 10. In general, the railway vehicle 1 includes an anti-rolling device connecting a lower face of the vehicle body (underframe 10) and the bogie 7, in order to reduce rolling oscillation of the vehicle body. The anti-rolling device is provided to the end portions in the y-direction of the bolster beam 12, and thus this may make it difficult to adopt the yaw damper receiving portion 14 in a manner where the two trapezoidal portions, each having the upper long side and the lower short side, are continuously provided.

In order to deal with such a case, a structure according to this embodiment includes a yaw damper receiving portion 14*a* including a single trapezoidal portion having an upper long side and a lower short side, and an auxiliary yaw damper receiving portion 14*b* provided on the lower face of the underframe 10 in a manner to extend the bolster beam 12 in the x-direction. The structure according to this embodiment includes the yaw damper support portion 17 in a manner to extend across the yaw damper receiving portion 14*a* and the auxiliary yaw damper receiving portion 14*b*.

The yaw damper receiving portion 14*a* includes a first face plate 70, an upper end edge portion 71, a bottom plate 72, a first inclined portion 73*a*, and a second inclined portion 73*b*. The first face plate 70 includes the single trapezoidal portion having the upper long side and the lower short side, and the long side and the short side are arranged in a manner to extend in the vehicle longitudinal direction. The upper end edge portion 71 is provided across substantially the entire length of an upper end edge of the first face plate 70. The bottom plate 72 extends in the vehicle width direction from a portion corresponding to the short side of the trapezoidal portion of the first face plate 70. The first inclined portion 73*a* connects one end edge portion in the vehicle longitudinal direction of the bottom plate 72 and one end portion in the vehicle longitudinal direction of the upper end edge portion 71. The second inclined portion 73*b* connects the other end edge portion in the vehicle longitudinal direction of the bottom plate 72 and the other end portion in the vehicle longitudinal direction of the upper end edge portion 71.

Similarly to the yaw damper receiving portion 14 described above, the yaw damper receiving portion 14*a* is welded to the lower end portion of the side structure 20, the side beam 11, and the bolster beam 12, in a manner to extend thereacross. An upper end of the upper end edge portion 71 of the yaw damper receiving portion 14*a* and sides of a pair of end face portions 77 thereof are welded to the vehicle outer face plate 20*a* (illustrated in each of FIGS. 5 and 6) of the side structure 20 through a weld portion 90*a*. A side of the first inclined portion 73*a* of the yaw damper receiving portion 14*a* is welded to the vehicle outer face plate 11*a* (illustrated in each of FIGS. 5 and 6) of the side beam 11 and the bolster beam 12 through a weld portion 90*c*. A side of the second inclined portion 73*b* is welded to the vehicle outer face plate 11*a* of the side beam 11 and the bolster beam 12 through a weld portion 90*b*. Sides of first horizontal portions 74*a* are welded to the vehicle outer face plate 11*a* of the side beam 11 through weld portions 90*d*.

The first inclined portion 73*a* of the yaw damper receiving portion 14*a* is welded through the weld portion 90*c* across the bolster beam 12 and the side beam 11. Thus, an oscillating force F3 along the first inclined portion 73*a* is transmitted to the bolster beam 12 and the side beam 11. Similarly, the second inclined portion 73*b* is welded through the weld portion 90*b* across the bolster beam 12 and the side beam 11. Thus, an oscillating force F4 along the second inclined portion 73*b* is transmitted to the bolster beam 12, the side beam 11, and the side structure 20.

The first inclined portion 73*a* and the second inclined portion 73*b* are welded to the structure of the railway vehicle 1 in a manner to be inclined with respect to the x-direction and the z-direction (the weld portion 90*c* and the weld portion 90*b*). Thus, an x-direction component and a z-direction component of an oscillating force F2 input from the yaw damper support portion 17 to the yaw damper receiving portion 14*a* are oriented in a direction along a weld line of the weld portion 90*c* (90*b*), and high stress is less likely to be generated in the weld portions 90*c*, 90*b*. In addition, the allowable stress for the joint on which a repetitive load acts in the direction parallel to a weld line of a weld portion is higher than the allowable stress for the joint in the case where the repetitive load acts in the direction intersecting the weld line. Thus, endurance strength of the weld portion can be increased.

Therefore, according to this embodiment, it is possible to provide a rail vehicle that efficiently transmits, to a railway vehicle structure, an oscillating force transmitted from the bogie 7 to the underframe 10 via the yaw damper 8 and the yaw damper support portion 17, that has sufficient strength, and that can reduce the number of manufacturing steps.

It should be noted that the present invention is not limited to the embodiments described above, and includes various modifications. For example, the above embodiments have been described in detail for easy understanding of the present invention. Therefore, the present invention is not necessarily limited to those including all the configurations described therein. Further, a part of the configuration of one embodiment can be replaced with the configuration of another embodiment, and the configuration of another embodiment can be added to the configuration of one embodiment. Further, it is possible to add, delete, and replace another configuration with respect to a part of the configuration of each embodiment.

REFERENCE SIGNS LIST

1 railway vehicle
5 track
7 bogie
8 yaw damper
9 air spring
10 underframe

11 side beam
11*a* vehicle outer face plate
11*b* vehicle inner face plate
11*c* rib
12 bolster beam
12*a* lower face of bolster beam
13 floor portion
13*a* vehicle outer face plate
13*b* vehicle inner face plate
13*c* rib
14 (14*a*) yaw damper receiving portion
14*b* auxiliary yaw damper receiving portion
16 bolt
17 yaw damper support portion
20 side structure
20*a* vehicle outer face plate
20*b* vehicle inner face plate
20*c* rib
70 first face plate
71 upper end edge portion
72 bottom plate
72*a* lower face
72*b* bolt hole
73*a* first inclined portion
73*b* second inclined portion
74*a* first horizontal portion
74*b* second horizontal portion (horizontal portion above bottom plate)
74*c* third horizontal portion
75 second face plate
76 vertical portion
77 end face portion
80 water drainage flow passage
90*a*, 90*d* weld portion
P opening
F1, F4 various forces such as oscillating force

The invention claimed is:

1. A rail vehicle comprising:

an underframe including: a floor portion forming a floor; a side beam provided in a vehicle longitudinal direction along an end portion in a vehicle width direction of the floor portion; and a bolster beam provided on a lower face of the side beam and a lower face of the floor portion, the bolster beam extending in the vehicle width direction across the side beam and the floor portion;

a side structure erected on an end portion in the vehicle width direction of the underframe;

a bogie supporting the underframe from below the underframe;

a yaw damper receiving portion provided to the end portion in the vehicle width direction of the underframe;

a yaw damper support portion fixed to the yaw damper receiving portion; and a yaw damper including one end portion connected to the bogie and another end portion connected to the yaw damper support portion, the yaw damper being configured to reduce yawing oscillation of the bogie, wherein the yaw damper receiving portion is provided to extend along the side structure, the side beam, and the bolster beam.

2. The rail vehicle according to claim 1, wherein the yaw damper receiving portion includes:

a first face plate including two trapezoidal portions having respective upper long sides and respective lower short sides, the respective upper long sides of the two trapezoidal portions being arranged adjacent to each other in a manner to be substantially a same straight line in the vehicle longitudinal direction, the two trapezoidal portions being arranged in a manner to belong to substantially a same plane;

an upper end edge portion provided across substantially an entire length of an upper end edge of the first face plate;

bottom plates extending in the vehicle width direction from respective portions corresponding to the respective lower short sides of the two trapezoidal portions of the first face plate;

first inclined portions connecting respective one end edge portions in the vehicle longitudinal direction of the bottom plates and a central portion in the vehicle longitudinal direction of the upper end edge portion; and second inclined portions connecting respective another end edge portions in the vehicle longitudinal direction of the bottom plates and respective end portions in the vehicle longitudinal direction of the upper end edge portion.

3. The rail vehicle according to claim 2, wherein each of the first inclined portions of the yaw damper receiving portion is welded across the side beam and the bolster beam.

4. The rail vehicle according to claim 2, wherein each of the second inclined portions of the yaw damper receiving portion is welded across the side structure, the side beam, and the bolster beam.

5. The rail vehicle according to claim 2, wherein the yaw damper receiving portion further includes:

pairs of vertical portions, each pair of vertical portions extending upward in a vertical direction from both end edge portions in the vehicle longitudinal direction of a corresponding one of the bottom plates, each pair of vertical portions connecting the both end edge portions of the corresponding one of the bottom plates and the upper end edge portion;

horizontal portions, above the bottom plates, each connecting central portions in a height direction of a corresponding one of the pairs of vertical portions;

second face plates each connecting lower end portions of a corresponding one of the pairs of vertical portions and an edge portion of a corresponding one of the bottom plates, the second face plates being arranged substantially parallel to the first face plate; and openings each of which is a space formed by a corresponding one of the pairs of vertical portions, a corresponding one of the horizontal portions above the bottom plates, a corresponding one of the bottom plates, and a corresponding one of the second face plates, the openings passing through the first face plate to open in the vehicle width direction.

6. The rail vehicle according to claim 5, wherein a flow passage configured to drain water is provided between each of the second face plates and the bolster beam.

7. The rail vehicle according to claim 2, wherein each of the bottom plates includes a lower face arranged to be substantially flush with a lower face of the bolster beam.

8. The rail vehicle according to claim 1, wherein the yaw damper receiving portion is fixed to the side structure and the underframe.

9. The rail vehicle according to claim 2, wherein the yaw damper support portion is fixed to the bottom plates of the yaw damper receiving portion.

10. The rail vehicle according to claim 1, wherein the yaw damper support portion is provided to extend across the yaw damper receiving portion and an auxiliary yaw damper receiving portion provided, on a lower face of the underframe, in a manner to extend the bolster beam in the vehicle longitudinal direction, and the yaw damper receiving portion includes:

a first face plate including a single trapezoidal portion having an upper long side and a lower short side, the upper long side and the lower short side of the single trapezoidal portion being arranged in a manner to extend in the vehicle longitudinal direction;

an upper end edge portion provided across substantially an entire length of an upper end edge of the first face plate;

a bottom plate extending in the vehicle width direction from a portion corresponding to the lower short side of the single trapezoidal portion of the first face plate;

a first inclined portion connecting one end edge portion in the vehicle longitudinal direction of the bottom plate and one end portion in the vehicle longitudinal direction of the upper end edge portion; and a second inclined portion connecting another end edge portion in the vehicle longitudinal direction of the bottom plate and another end portion in the vehicle longitudinal direction of the upper end edge portion.

* * * * *